US007779932B2

(12) United States Patent
Hartung et al.

(10) Patent No.: US 7,779,932 B2
(45) Date of Patent: Aug. 24, 2010

(54) DRILL-STRING SHOCK ABSORBERS

(75) Inventors: Markus Hartung, Hunfeld (DE); Stefan Wrede, Kirchhundem (DE); Christof Kruse, Wenden (DE)

(73) Assignee: Longyear TM, Inc., South Jordan, UT (US)

( * ) Notice: Subject to any disclaimer, the term of this patent is extended or adjusted under 35 U.S.C. 154(b) by 180 days.

(21) Appl. No.: 12/253,082

(22) Filed: Oct. 16, 2008

(65) Prior Publication Data

US 2009/0101412 A1 Apr. 23, 2009

Related U.S. Application Data

(60) Provisional application No. 60/981,708, filed on Oct. 22, 2007.

(51) Int. Cl.
*E21B 17/00* (2006.01)

(52) U.S. Cl. ..... 175/56; 175/321; 464/20

(58) Field of Classification Search ..... 175/56, 175/321; 188/321.11, 322.16; 464/20, 96
See application file for complete search history.

(56) References Cited

U.S. PATENT DOCUMENTS

| | | | | |
|---|---|---|---|---|
| 3,746,330 | A | 7/1973 | Taciuk | |
| 3,947,009 | A | 3/1976 | Nelmark | |
| 4,571,215 | A * | 2/1986 | Hansen | 464/180 |
| 4,844,181 | A * | 7/1989 | Bassinger | 175/195 |
| 5,083,755 | A * | 1/1992 | Nenkov et al. | 267/135 |
| 5,372,548 | A | 12/1994 | Wohlfeld | |
| 5,377,772 | A | 1/1995 | Gien | |
| 5,476,421 | A | 12/1995 | Moore et al. | |

* cited by examiner

*Primary Examiner*—William P Neuder
(74) *Attorney, Agent, or Firm*—Workman Nydegger

(57) ABSTRACT

Implementations of the present invention relate generally to methods, systems, and apparatus for absorbing vibration and shock impulses created during drilling operations. In particular, implementations of the present invention include drill-string shock absorbers adapted to absorb longitudinal forces produced during a drilling operation. For example, drill-string shock absorbers in accordance with at least one implementation of the present invention include a generally cylindrical housing having a first end and a second end coupled together by a radially interlocking joint. Such a configuration can reduce mechanical failure and increase the operating life of the shock absorber by transmitting torsional forces directly between the ends of the housing and reducing stresses from being transferred to fastening means securing the first and second ends of the cylindrical housing together.

21 Claims, 5 Drawing Sheets

DRILL-STRING SHOCK ABSORBERS

CROSS-REFERENCE TO RELATED APPLICATIONS

This application claims the benefit of U.S. Provisional Application No. 60/981,708, filed Oct. 22, 2007, entitled "Shock Absorbers for Down-the-Hole Hammers," the content of which is hereby incorporated by reference in its entirety.

BACKGROUND OF THE INVENTION

1. The Field of the Invention

The present invention relates generally earth-boring tools that may be used to drill subterranean formations. More particularly, the present invention relates to shock absorbers for absorbing forces or loads applied to a drill string during a drilling operation.

2. Background and Relevant Art

In various types of earth-boring drilling operations, a drilling machine drives a drill bit or other earth-boring tool, into an earthen formation to penetrate and remove portions of the formation. For example, an earth-boring tool is secured to one end of a drill string, which includes a plurality of tubular members and equipment segments coupled end to end. The opposing end of the drill string is in turn secured to a drilling machine (e.g., drill head, rotary head, double head system) located at the surface. The drill bit is positioned such that the cutting elements located thereon are adjacent the earthen formation to be drilled. The drilling machine may then force the drill bit downward, while also rotating the drill string and the drill bit, in order to penetrate and remove portions of the earthen formation.

Drilling operations may require the use of both longitudinal downward force and rotational force (torque), depending on the type of drilling operation and the material being drilled. Furthermore, during drilling the conditions of the material being penetrated and the bore hole may vary leading to a fluctuation in stresses and forces being transmitted up the drill string to the drilling machine. These fluctuating stresses may include vibration and shock impulses that may present various problems. For example, the shock impulses may cause the drill bit to hop, which in turn may cause the drill bit to cut slowly or unevenly through the formation. Also, the vibration and shock impulses may cause mechanical wear and eventually lead to failure of various part of a drilling system. Each of these problems, and others, can increase the time and cost of the drilling operation.

In order to reduce potential problems due to vibration and shock impulses, shock absorbers can be used to dampen vibrations and absorb shock impulses that are created during drilling operations. A shock absorber, for example, can be a mechanical device designed to smooth out or dampen shock impulses and dissipate kinetic energy. Shock absorbers can include a dampening device that is connected between the drilling machine and the drill string. The dampening device can help reduce the transfer of vibration and shock impulses created during the drilling operation from reaching the drilling head or other parts of the drilling system. Such dampening devices can include some type of resilient material that absorbs the vibration and shock impulses, and dissipates undesired kinetic energy associated with the drilling operation.

One type of conventional shock absorber includes two parallel plates with a rubber disk located therebetween. A driving plate is secured, either directly or indirectly, to the drilling system's rotary drive and a driven plate is secured to the drill string. The plates are typically connected together by a set of fasteners (e.g., screws). As longitudinal shock impulses are transmitted up the drill string, the two horizontal plates are forced together, thereby compressing the rubber disk. The compression of the rubber disk at least partially absorbs the longitudinal shock impulse and dissipates the energy as heat.

While this type of shock absorber may be capable of dampening most longitudinal shock impulses imparted to the drill string, they may not respond to torsional forces and rotational vibrations. In particular, as rotational forces are transferred from the drilling head to the drill string they can be transmitted through the shock absorber. As the rotational forces are exerted on the driving plate, they are can be transferred to the fasteners securing the plates together or even the rubber disks. Thus, a shearing force may be exerted on the fasteners and rubber disks, which can cause damage to the rubber disks. For example, the rubber disks may frequently develop long holes due to friction caused by the screws, which can lead to mechanical failure.

Other conventional shock absorbers can present the same problems or additional ones. For example, pneumatic and hydraulic shock absorbers can be bulky, require additional equipment and systems to properly function, and can be expensive. One will appreciate that the problems associated with conventional shock absorbers discussed above may lead to any number of undesirable consequences. For example, conventional shock absorbers may tend to wear out within a relatively short time, particularly when subjected to large torsional forces. The short working life of conventional shock absorbers may necessitate the need for frequent repair or replacement and thereby may increase drilling costs.

Accordingly, there are a number of disadvantages in conventional shock absorbers that can be addressed.

BRIEF SUMMARY OF THE INVENTION

Implementations of the present invention overcome one or more problems in the art with systems, methods, and apparatus for absorbing longitudinal forces created during drilling operations. For example, implementations of the present invention include drill-string shock absorbers capable of absorbing both vibrations and shock impulses without leading to premature wear or failure. In particular, implementations of the present invention include shock absorbers configured to transmit rotational forces directly between ends of a generally cylindrical housing and reduce stresses applied to a shock absorbing system located within the cylindrical housing.

For example, an apparatus for reducing vibration and shock in a drill string during a drilling operation in accordance with at least one implementation of the present invention includes a cylindrical housing including a first end and a second end coupled together by a radially interlocking joint formed by abutting surfaces of said first end and said second end. The apparatus further includes a shock absorbing assembly disposed within said cylindrical housing adapted to absorb and dissipate shock impulses.

In addition, a drill-string shock absorber in accordance with another implementation of the present invention includes a first housing member adapted to be coupled to a rotary drive; a second housing member adapted to be coupled to a drill string; a shock absorbing assembly longitudinally disposed between said first housing member and said second housing member; and a plurality of fasteners extending from said second housing member through said shock absorbing assembly and into said first housing member. The drill-string shock absorber also includes a plurality of radially interlocking members formed by abutting surfaces of said first housing member and said second housing member, said radially interlocking members adapted to transmit torque directly from said first housing member to said second housing member and reduce stresses experienced by said plurality of fasteners.

Furthermore, a drill-string shock absorber in accordance with yet another implementation of the present invention includes a first flange comprising at least one engagement member extending longitudinally from an outer radial wall of said first flange and a second flange comprising at least one recess extending longitudinally into an outer radial wall of said second flange, said at least one recess of said second flange being adapted to operatively engage said at least one engagement member of said first flange and to transmit torque directly from said first flange to said second flange. The drill-string shock absorber also includes a piston including a flange disposed between said first flange and said second flange; at least a first shock absorbing member disposed between said first flange and said piston flange; and at least a second shock absorbing member disposed between said piston flange and said second flange.

Additionally, a drilling system in accordance with another implementation of the present invention includes a tool string comprising a plurality of tubular members; an earth-boring tool secured to a first end of said tool string; a rotary drill head coupled to an second end of said tool string, said rotary drill head configured to rotate said tool string; and a shock absorber secured between said rotary drill head and said tool string. The shock absorber includes a cylindrical housing including a first end and a second end coupled together by a radially interlocking joint formed by abutting surfaces of said first end and said second end; and a shock absorbing assembly disposed within said cylindrical housing adapted to absorb and dissipate shock impulses.

Furthermore, a method of absorbing vibration and shock impulses during a drilling operation includes coupling a portion of a tool string to a shock absorber secured to a rotary drill head. The shock absorber includes a first housing member including an outer radial wall, said outer radial wall including one or more engagement members extending longitudinally therefrom. The shock absorber further includes a second housing member including an outer radial wall, said outer radial wall including one or more recesses extending longitudinally therein and a shock absorbing assembly disposed between said first housing member and said second housing member. The method also includes rotating said rotary drill head to cause said one or more engagement members to operatively engage said one or more recesses and thereby transmit torque directly from said first housing member to said second housing member.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention overcome one or more problems in the art with systems, methods, and apparatus for absorbing longitudinal forces created during drilling operations. For example, implementations of the present invention include drill-string shock absorbers capable of absorbing both vibrations and shock impulses without leading to premature wear or failure. In particular, implementations of the present invention include shock absorbers configured to transmit rotational forces directly between ends of a generally cylindrical housing and reduce stresses applied to a shock absorbing system located within the cylindrical housing.

As will be appreciated more fully herein, implementations of the present invention provide shock absorbers capable of absorbing vibration and shock impulses over an extended operating life. In particular, by reducing stresses applied to the dampening components within the shock absorber, mechanical wear can be reduced. Thus, the operating life of the drill-string shock absorber can be increased. Additionally according to some implementations, shock absorbers of the present invention provide one or more of the forgoing benefits, while also being relatively inexpensive to manufacture and relatively compact in size.

One will appreciate that the shock absorbers of the present invention can be used with any type of drilling operation where shock and vibration forces act on components of a drilling system. For example, FIGS. 1 and 2, and the corresponding text, illustrate or describe a number of different drilling systems with which drill-string shock absorbers of the present invention can be used. One will appreciate, however, the drilling systems shown and described in FIGS. 1 and 2 are only examples of the types of systems with which shock absorbers of the present invention can be used.

Figure 1:
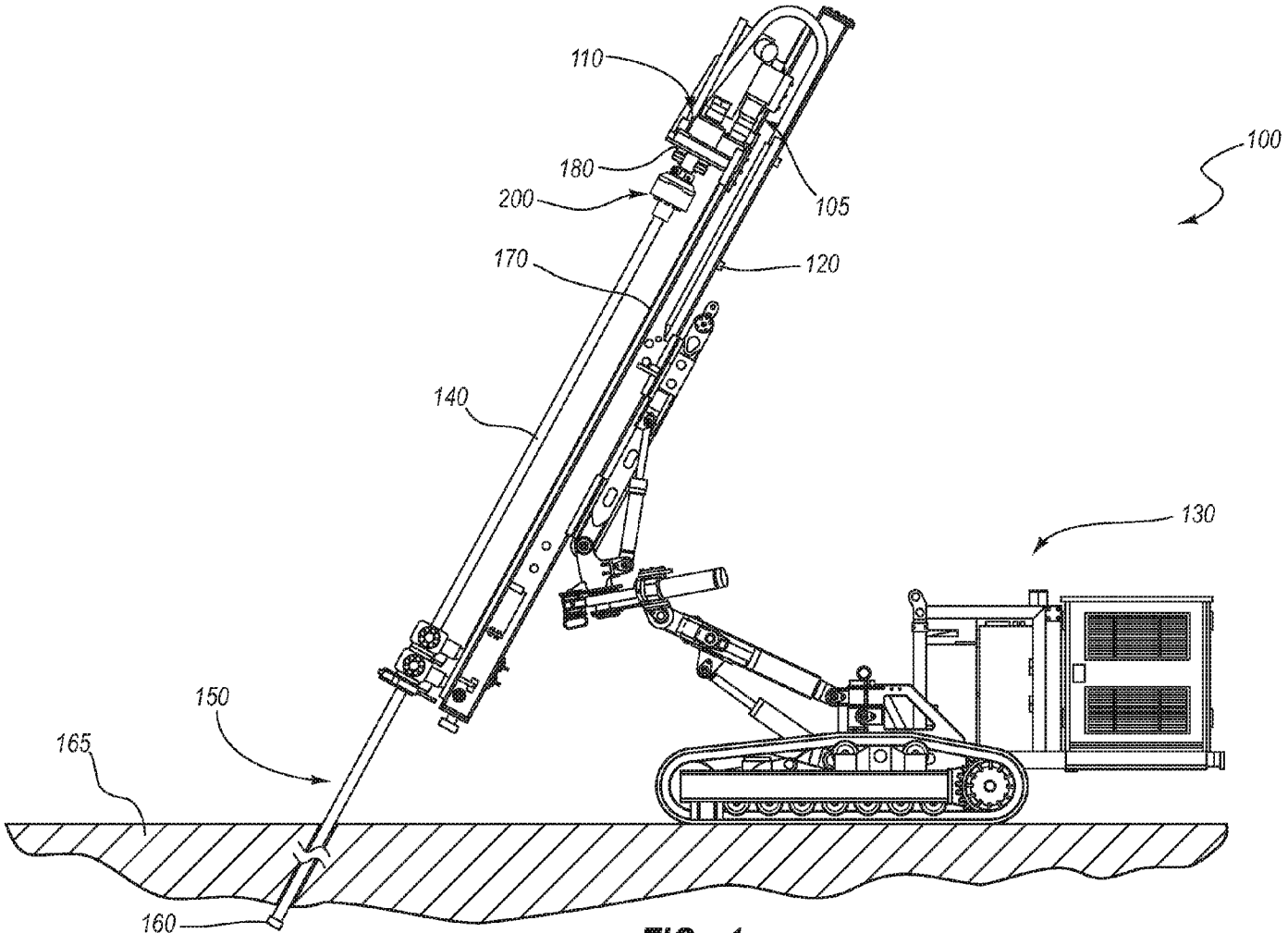
FIG. 1 illustrates a schematic view of a drilling system including a drill-string shock absorber in accordance with an implementation of the present invention.
Figure 2:
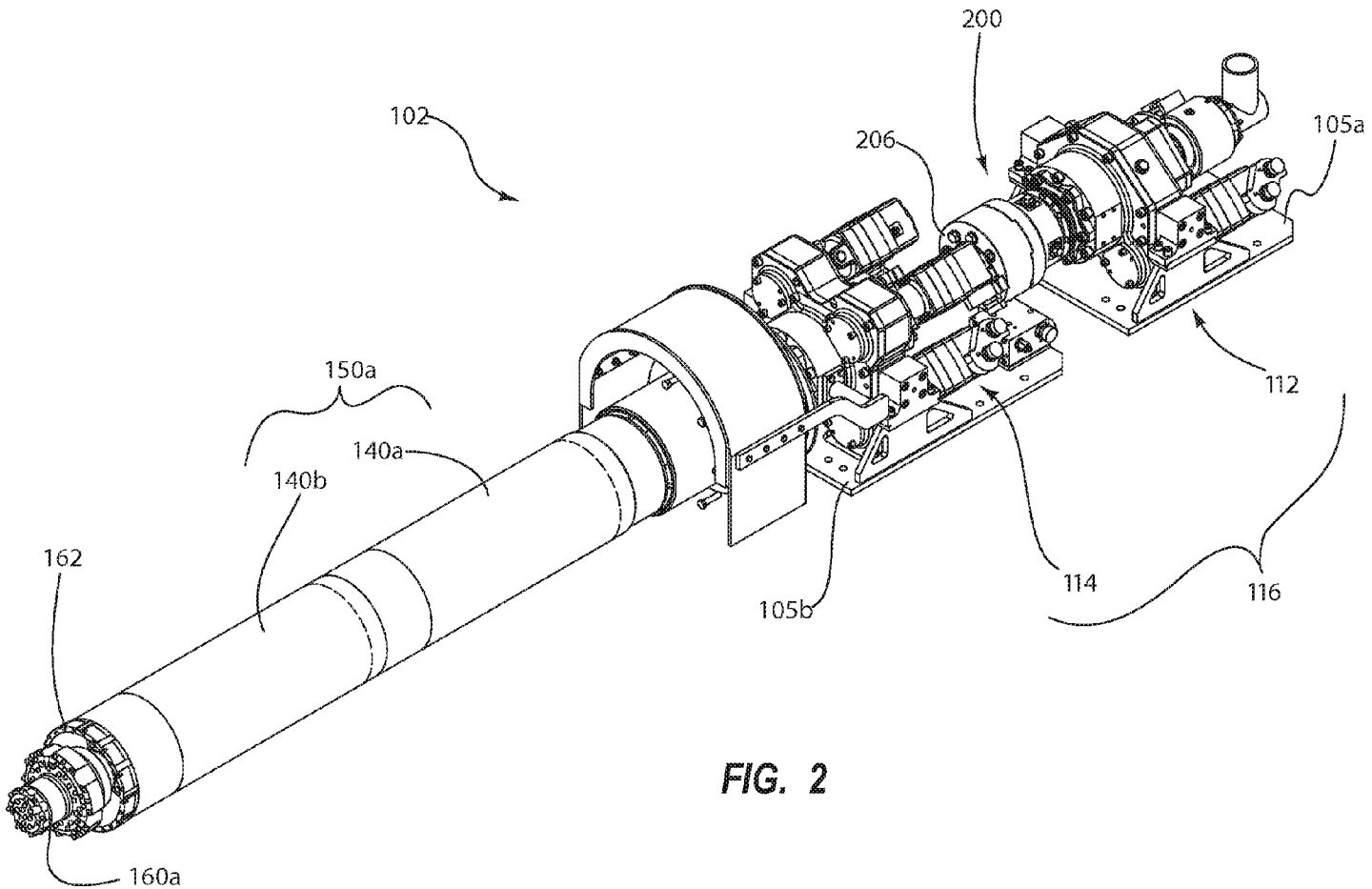
FIG. 2 illustrates a schematic view of a drill-string shock absorber in accordance with an implementation of the present invention secured between a drilling head of a double-head drilling system and a down-the-hole hammer.

For example, FIG. 1 illustrates a drilling system 100 that includes a sled assembly 105 and a drill head 110. The sled assembly 105 can be coupled to a mast 120 that in turn is coupled to a drill rig 130. The drill head 110 can be configured to have one or more tubular threaded member 140 coupled thereto. Tubular members can include, without limitation, drill rods, casings, and down-the-hole hammers. For ease of reference, the tubular members 140 will be described herein after as drill string components. The drill string component 140 can in turn be coupled to additional drill string components 140 to form a drill or tool string 150. In turn, the drill string 150 can be coupled to earth-boring tool 160, such as a rotary drill bit or percussive bit, configured to interface with the material 165, or formation, to be drilled.

In at least one example, the drill head 110 illustrated in FIG. 1 is configured rotate the drill string 150 during a drilling process. In particular, the drill head 110 may vary the speed at which the drill head 110 rotates. For instance, the rotational rate of the drill head and/or the torque the drill head 110 transmits to the drill string 150 may be selected as desired according to the drilling process.

Furthermore, the sled assembly 105 can be configured to translate relative to the mast 120 to apply a generally longitudinal downward force to the drill head 110 to urge the drill bit 160 into the formation 165 during a drilling operation. In the illustrated example, the drilling system 100 includes a chain-drive assembly 170 that is configured to move the sled assembly 105 relative to the mast 120 to apply the generally longitudinal force to the drill bit 160 as described above.

As used herein the term "longitudinal" means along the length of the drill string 150. Additionally, as used herein the terms "upper" and "above" and "lower" and "below" refer to longitudinal positions on the drill string 150. The terms "upper" and "above" refer to positions nearer the drill head 110 and "lower" and "below" refer to positions nearer the earth-boring tool 160.

Also, as shown in FIG. 1, the drilling system can further include a shock absorber 200. The shock absorber 200 can be secured between the drill head 110 and the drill string 150. Furthermore, the shock absorber 200 can be adapted to transmit rotational and longitudinal forces from the drill head 110 to the drill string 150. The shock absorber 200 can also be adapted to dampen or absorb vibration and shock impulses imparted to the drill string 150 during the drilling process as explained in greater detail below.

As shown in FIG. 1, the shock absorber 200 can be configured to be part of the drill string 150, and therefore, can be generally cylindrical and elongate in shape. Furthermore, in some implementations of the present invention, the diameter of the shock absorber 200 can be sized and configured to allow the shock absorber 200 to fit within a bore hole.

While FIG. 1 illustrates the shock absorber 200 in use with a top hydraulic drill head 110, one will appreciate that the shock absorber 200 can be implemented and used without employing these specific details. Indeed, the shock absorber 200 and associated method of use can be placed into practice by modifying the apparatus and associated method and can be used in conjunction with most drilling systems used in industry. For example, while the description below focuses on using shock absorbers 200 with drill rigs normally employed in foundation and exploration drilling, the shock absorbers 200 could be adapted to be used with drill rigs employed in the oil and gas industries or to any other drilling application.

Indeed, the drill-string shock absorbers 200 of the present invention can be used with various types of drilling systems, including for example, systems employing rotary drilling, percussive drilling, or sonic drilling. For example, FIG. 2 illustrates the shock absorber 200 being used with a down-the-hole hammer (located within the drill string 150*a*) drilling system 102 driven by a double-head drilling device 116. The double-head drilling device 116 is carried by sled components 105*a*, 105*b*, which can be secured to a mast of a drill rig or other support system, such as the mast 120 of the drilling rig 130 shown in FIG. 1.

The front drill head 114 of the double-head drilling system 116 can be coupled to segments of casing 140*a*, 140*b* forming a drill string 150*a*, which can be tipped with a casing bit 162. The rear drill head 112 of the double-head drilling system 116 can be coupled to a down-the-hole hammer capped with a percussion bit 160*a* via a shock absorber 200. The rear drill head 112 can be adjustable relative to the front drill head 114 such that the rotary heads 112, 114 can operate in counter-rotating directions. Such counter-rotating direction of rotation can make accurate drilling possible and prevent inadvertent release of rod and casing segments 140 when they are changed.

Drilling using a down-the-hole hammer drilling system 102 can efficiently combine a percussive action with rotation for fast and economical drilling. In such drilling operations, the down-the-hole hammer can be pneumatically driven (such as with compressed air) by a percussive unit located within the borehole. The percussive unit can repeatedly drive percussion bit 160*a*, in a reciprocative manner, against an earth formation. At the same time the percussion bit 160*a* is being percussively driven against the earth formation, the drill head 112 can rotate the down-the-hole hammer to further facilitate drilling. Because of the repeated percussive action of the down-the-hole hammer, the components of the down-the-hole hammer drilling system 102 can be exposed to potentially damaging shock impulses.

The shock absorber 200 can be configured, as explained in greater detail below, to transmit the torsional forces required for rotating the percussive bit 160*a* from the rear drill head 112, while also absorbing at least a portion of shock and vibrations produced by down-the-hole hammer drilling operations. In particular, the shock absorber 200 can absorb at least a portion of the shock and vibration forces transmitted up the drill string 150*a* and reduce damage to the double head drilling device 116 and other equipment secured upwards of the shock absorber 200.

One will appreciate in light of the disclosure herein, according to at least some implementations, the shock absorber 200 of the present invention may be suited for use with down-the-hole hammer drilling systems and other systems with a percussive unit positioned below the shock absorber 200, or in other words positioned between the shock absorber 200 and an earth-boring tool 160.

Figure 3:
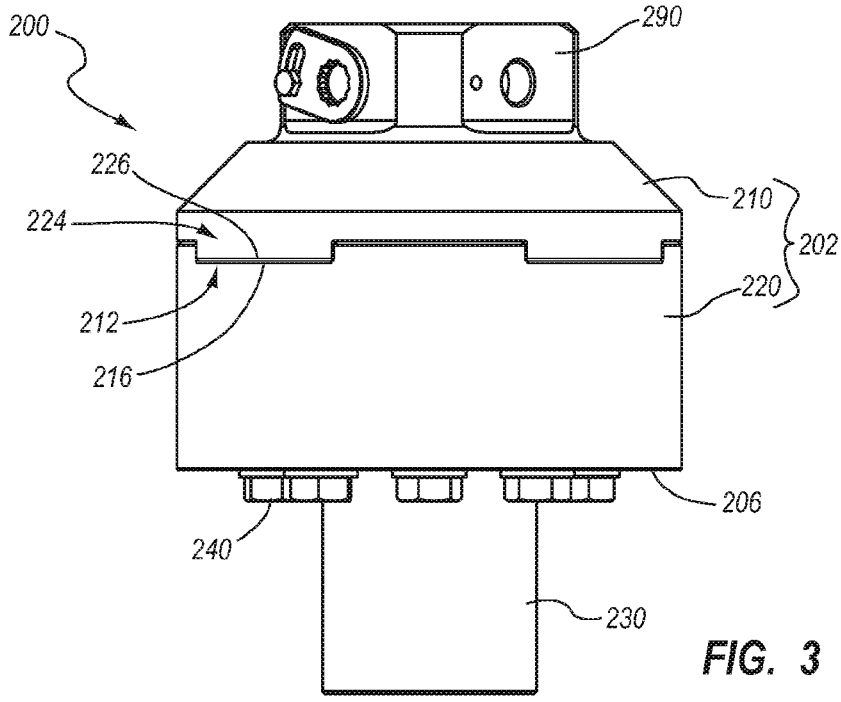
FIG. 3 illustrates a side view of a drill-sting shock absorber in accordance with an implementation of the present invention.
Figure 4:
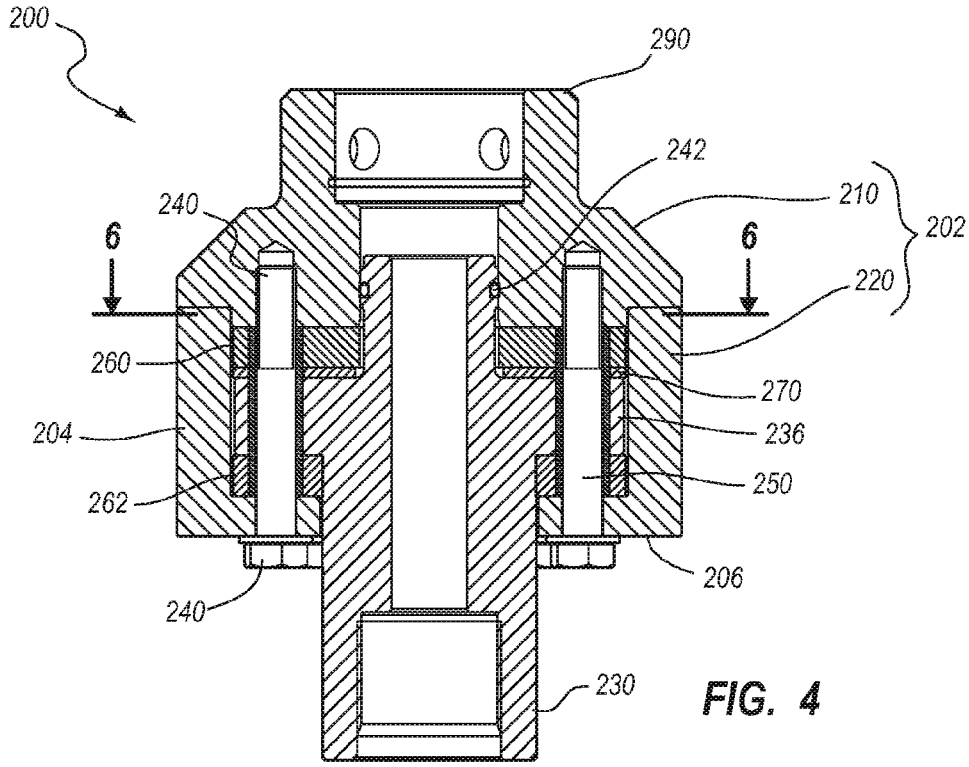
FIG. 4 illustrates a cross-sectional view of the drill-string shock absorber of FIG. 3 in accordance with an implementation of the present invention.
Figure 5:
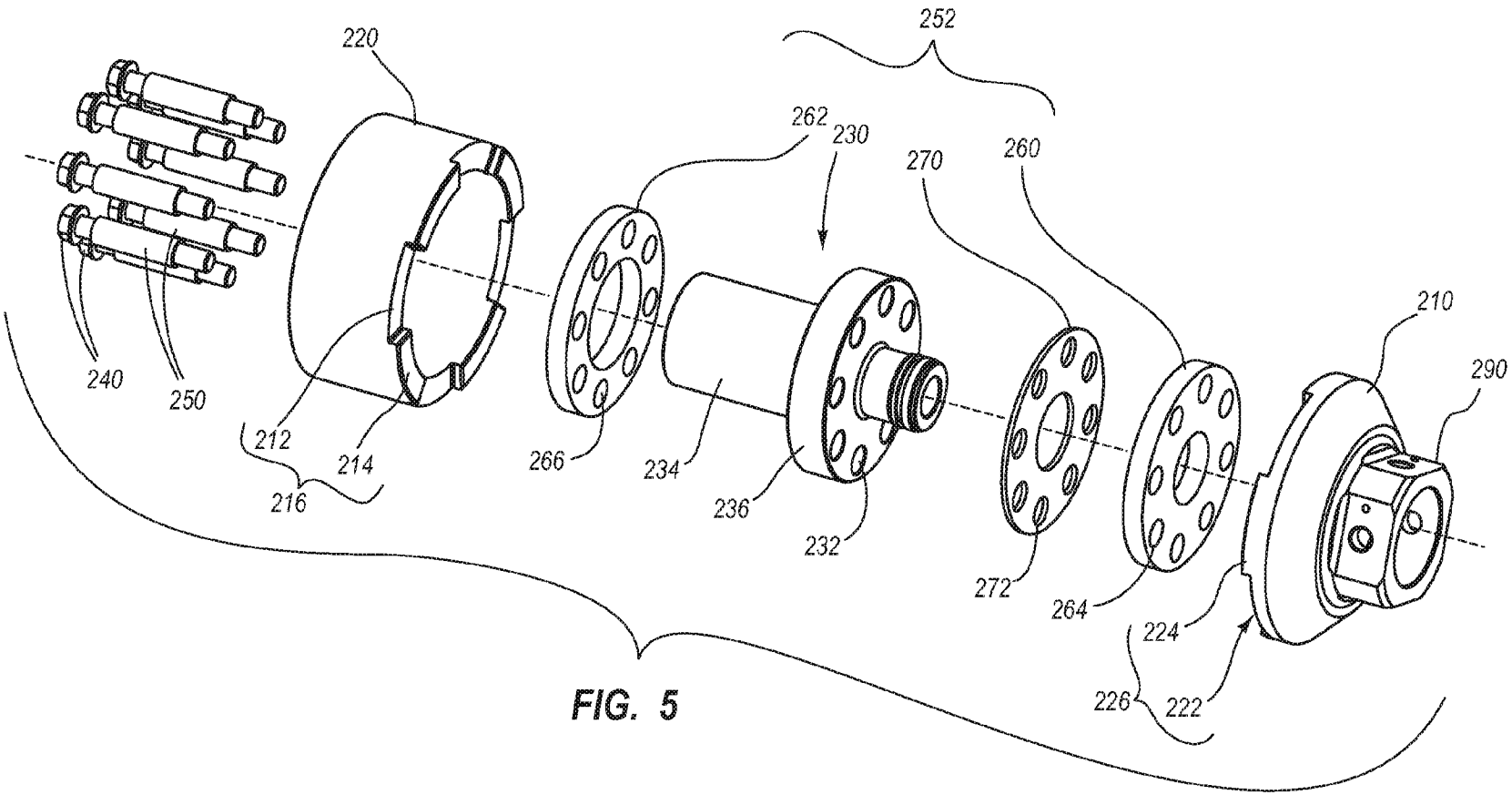
FIG. 5 illustrates an exploded perspective-view of the drill-string shock absorber of FIG. 3 in accordance with an implementation of the present invention.
Figure 6:
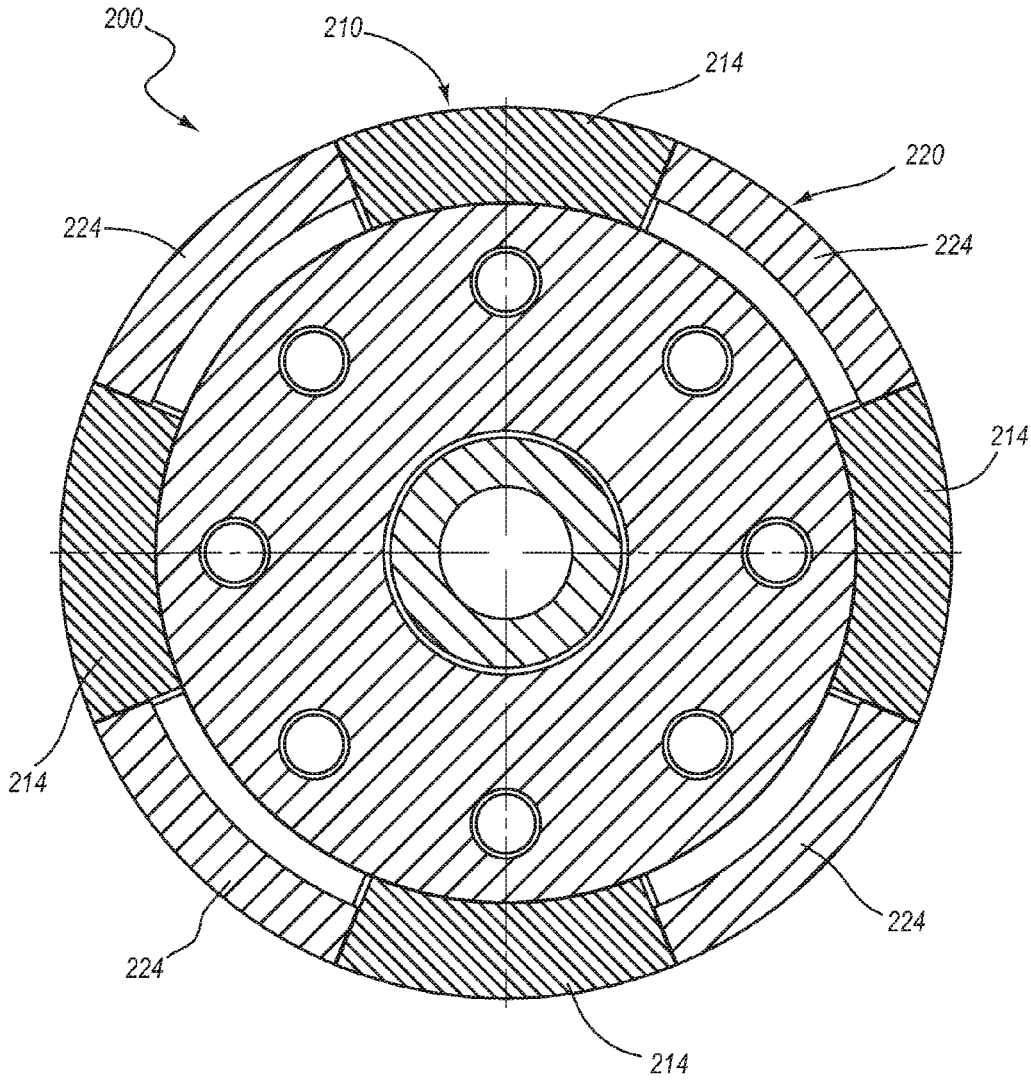
FIG. 6 illustrates a cross-sectional view of the drill-string shock absorber of FIG. 4 taken along the section line 6-6 shown therein.

FIGS. 3 through 6, and the corresponding text, illustrate or describe a number of details and features/uses of the shock absorbers 200 shown in FIGS. 1 and 2. For example, FIG. 3 and 4 illustrate a side and side cross-sectional views of a shock absorber 200 shown in FIGS. 1 and 2. FIG. 5, on the other hand, illustrates an exploded, side-perspective view of components of the shock absorber 200 of FIG. 3. FIG. 6, in turn, illustrates a cross-sectional view of the shock absorber 200 taken along the section line 6-6 shown in FIG. 4.

As shown in FIGS. 3-5, the shock absorber 200 can include a generally cylindrical housing 202 comprising a first end 210 and a second end 220. The first end 210 of the cylindrical housing 202 can include a driving flange 290 adapted to be secured mechanically and/or electrically to a drill head, such as for example shown in FIG. 2. One will appreciate in light of the disclosure provided herein, that the driving flange 290 can be configured based on the type of drill head used. For example, the driving flange 290 can include a threaded connection, such as for example, an American Petroleum Institute (API) threaded connection, or other connections means suitable for connection to a particular rotary drive or drill head.

FIG. 3 also illustrates that the second end 220 can include an output flange 206 configured to be driven by the driving flange 290. The first end 210 can be secured to the second end 220 via a plurality of fasteners 240. In particular, abutting surfaces 216, 226 of the first and second ends 210, 220 can be configured to substantially match each other so that when they are forced together, they form a metal-to-metal seal.

Furthermore, as shown in FIG. 3, and as explained in greater detail below, the abutting surfaces of the first and second ends 210, 220 of the cylindrical housing 202 can be configured to form a radially interlocking joint. The radially interlocking joint formed by the abutting surfaces 216, 226 can ensure that at least a portion if not all of any rotational force imparted to the first end 210 of the cylindrical housing 202 is transferred directly to the second end 220 of the cylindrical housing 202 and not to the plurality of fasteners 240 or other components housed within the cylindrical housing 202. In other words, the radially interlocking joint formed by the abutting surfaces 216, 226 of the cylindrical housing 202 can help ensure that a shear force is not imparted to the plurality of fasteners 240 as a drill head rotates the shock absorber 200.

As shown in FIG. 5, the cylindrical housing 202 can contain a shock absorbing assembly 252 adapted to absorb and dissipate shock impulses. The shock absorbing assembly 252 can include a piston 230 including a stem 234 and a piston flange 236 extending radially outward from the stem 234. The piston stem 234 can be configured to be secured to drill string component such as a down-the-hole hammer, drill rod, or drill casing.

FIG. 5 also illustrates that the shock absorbing assembly 252 can include one or more shock absorbing members 260, 262 disposed on either side of the piston flange 236. For example, FIG. 5 illustrates that a first, or upper shock absorbing member 260 can be positioned adjacent an upper surface of the piston flange 236 and a second, or lower shock absorbing member 262 can be positioned adjacent an upper surface of the piston flange 236.

The first and second shock absorbing members 260, 262 can comprise discs formed from a resilient material. For example, in some embodiments, the first and second shock absorbing members can comprise discs formed from a natural or synthetic based rubber material. Additionally, while FIG. 5 illustrates a single shock absorbing member 260 placed above the piston flange 236 and a single shock absorbing member 262 placed below the piston flange 236, the shock absorber 200 can include any number of shock absorbing members. For example, according to some implementations of the present invention, the shock absorber 200 can include multiple shock absorbing members 260, 262 disposed on either side of the piston flange 236. The total number of shock absorbing members 260, 262 can be varied to increase or decrease the shock absorbing capabilities of the shock absorber 200.

In addition, to varying the number of shock absorbing members 260, 262, the size, shape, and/or composition of the shock absorbing members 260, 262 can be modified to change the shock absorbing capacities of the shock absorber 200. For example, the thickness of the shock absorbing members 260, 262 can be increased to increase the shock absorbing capabilities of the shock absorber 200. One will appreciate that the number and size of the shock absorbing members, and thus the ability of the shock absorber to absorb shock impulses, can be varied depending upon the type of drilling operation (e.g., rotary, percussive, sonic, etc.) and the material being drilled (rock, soil, etc.).

Thus, the shock absorber 200 can act to absorb and reduce forces from being transmitted to components located above the shock absorber 200. In particular, the stem 234 of the piston 230 can be coupled to a drill string member (a drill rod, drill casing, down-the-hole hammer, etc.). When the drills string member receives an impact or force, including one or both of a longitudinal force and a torsional force, generated by a earth-boring tool as it penetrates and earthen formation, the piston flange 236 may be forced to extend toward the first end 210 of the generally cylindrical housing 202 and compress the first shock absorbing member 260, which thereby absorbs at least a portion of the force. Thereafter, the piston flange 236 can be forced to compress toward the second end 220 and compress the second shock absorbing member 262, which thereby absorbs at least an additional portion of the force. Depending on the intensity of the force applied to the shock absorber 200, the piston 230 and piston flange 234 can cycle through the compressed and extended positions several times to dissipate the energy of the force that is applied to the shock absorber 200.

Also, shown in FIG. 5, the shock absorbing assembly 252 can also include one or more discs 270 disposed between the piston flange 236 and the shock absorbing members 260, 262. The one or more discs 270 can provide a buffer between the piston flange 236 and the shock absorbing members 260, 262 and help ensure that any shock received by the piston flange 236 is evenly distributed to the shock absorbing members 260, 262.

As mentioned previously, the first and second ends 210, 220 of the generally cylindrical housing 202 can be secured together by a plurality of fasteners 240. The plurality of fasteners can also secure each of the components of the shock absorbing assembly 252 to the cylindrical housing 202. In particular, each of the shock absorbing members 260, 262, the piston flange 236, and one or more discs 270 can include a respective plurality of holes 264, 266, 232, 272 through which the plurality of fasteners 240 can extend.

More specifically in some implementations of the present invention, the shock absorbing members 260, 262, the piston flange 236, and one or more discs 270 can be coupled together by a plurality of sleeves 250 extending within the plurality of holes 264, 266, 232, 272. The plurality of sleeves 250 can provide a buffer between the plurality of fasteners 240 and the components of the shock absorbing assembly 252 to help decrease wear and stress from being imparted from the plurality of fasteners 240 to the components of the shock absorbing assembly 252. Thus, the plurality of sleeves 250 can help ensure that the plurality of fasteners 240 do not rub directly against or otherwise cause wear on the shock absorbing members 260, 262. Furthermore, in some implementations of the present invention, each sleeve of the plurality of sleeves can comprise multiple sleeves with multiple layers and/or materials.

FIG. 4 illustrates a side cross-sectional view of the shock absorber 200 in an assembled form. As shown in FIG. 4, the plurality of fasteners 240 can extend from the second end 220 of the generally cylindrical housing 202 through the shock absorbing member 262, the piston flange 136, the disc 270, and the shock absorbing member 260 and into the first end 210 of the generally cylindrical housing 202 to secure each of these components together.

Furthermore, FIG. 4 illustrates that the shock absorber 200 can include one or more seals or o-rings 242 between the piston 230 and the generally cylindrical housing 202. According to some implementations of the present invention, the seal can include one or more lip seals 242 formed within the first end 210 of the generally cylindrical housing 202. Accordingly, when the plurality of fasteners 240 are tightened, a substantial form closure can be created between the first end 210 and second end 220 of the generally cylindrical housing 202.

As mentioned previously, the abutting surfaces of the first and second ends 210, 220 of the cylindrical housing 202 can be configured to include a radially interlocking joint. The radially interlocking joint formed by the abutting surfaces 216, 226 can ensure that at least a portion if not all of the rotational force imparted to the first end 210 of the cylindrical housing 202 are transferred directly to the second end 220 of the cylindrical housing 202 and not to the plurality of fasteners 240 or other components positioned within the cylindrical housing 202. Thus, the radially interlocking joint formed by the abutting surfaces 216, 226 of the first and second ends 210, 220 can also help ensure that the components of the shock absorbing assembly 252, through which the plurality of fasteners 240 extend, also are not subjected to at least a portion if not all of the rotational forces being transferred through the shock absorber 200 from a drilling head 112. Additional features and details of the radially interlocking joint formed by the abutting surfaces 216, 226 are described herein below.

FIG. 4 illustrates that the generally cylindrical housing 202 can comprise a radial wall 204 extending between the driving flange 290 and the output flange 206 and around the components of the shock absorbing assembly 252. As shown in FIG. 4, the radial wall 204 can contain the abutting surfaces 216, 226 (FIG. 3) of the first and second ends 210, 220 of the generally cylindrical housing 202, and thus, contain the radially interlock joint defined by the abutting surfaces 216, 226.

Furthermore, as shown in FIGS. 3 and 5 the abutting surfaces 226 of the first end 210 of the generally cylindrical housing 202 can comprise at least one protrusion 224 extending longitudinally from the first end 210 of the generally cylindrical housing 202 toward the second end 220. Similarly, FIG. 5 illustrates that the second end 220 of the generally cylindrical housing 202 can include at least one recess 212 extending longitudinally therein. Furthermore, the at least one protrusion 224 of the first end 210 can be configured in size and shape to operatively engage the at least one recess 212 of the second end 220 to transmit torque directly from the first end 210 to the second end 220 and reduce at least of portion of stresses created during the drilling from being transmitted to the plurality of fasteners 140 or the components of the shock absorbing assembly 252.

According to additional implementations of the present invention, the abutting surfaces 216 of the second end 220 of the generally cylindrical housing 202 can comprise at least one protrusion 214 extending longitudinally from the second end 220 toward the first end 210. Similarly, FIG. 5 illustrates that the first end 210 of the generally cylindrical housing 202 can include at least one recess 222 extending longitudinally therein. Furthermore, the at least one protrusion 214 of the second end 220 can be configured in size and shape to operatively engage the at least one recess 222 of the first end 210 to transmit torque directly from the first end 210 to the second end 220 and reduce at least a portion of stresses created during drilling from being transmitted to the plurality of fasteners 140 or the components of the shock absorbing assembly 252.

Indeed, according to some implementations of the present invention the radially interlocking joint formed by the abutting surfaces 216, 226 can include any number of protrusions and corresponding recesses. For example, according to some implementations of the present invention, each of the abutting surfaces 216, 226 can include four longitudinally extending protrusions and four longitudinally extending recesses configured to operatively engage each other to transmit torque directly from the first end 210 of the generally cylindrical housing 202 to the second end 220. Thus as shown in FIG. 6, a cross-sectional view of the shock absorber 200 taken through the radially interlocking joint formed by the abutting surfaces 216, 226, the radially interlocking joint can comprise a plurality of radially alternating protrusions 214, 224 from the first end 210 and the second end 220 of the generally cylindrical housing 202. The radially alternating protrusions 214, 224 can positively interlock against each other to transmit torsional forces directly from the first end 210 of the generally cylindrical housing 202 to the second end 220 and reduce stresses being transferred to the plurality of fasteners 240.

The present invention also includes methods of drilling and absorbing vibration and shock impulses during a drilling operation. The following describes at least one implementation of a method using a shock absorber 200, such as shown in FIGS. 1-6, to absorb and dissipate vibration and shock impulses during a drilling operation. Of course, as a preliminary matter, one of ordinary skill in the art will recognize that the methods explained in detail can be modified to perform a wide variety of drilling operations according to one or more implementations of the present invention.

For example, at least one method of the present invention comprises an act of coupling a portion of a tool string to a shock absorber secured to a rotary drill head. In such and act, the shock absorber can include a first housing member including an outer radial wall, said outer radial wall including one or more engagement members extending longitudinally therefrom. The shock absorber can also include a second housing member including an outer radial wall, said outer radial wall including one or more recesses extending longitudinally therein. The shock absorber can further include a shock absorbing assembly disposed between said first housing member and said second housing member.

The method can also include an act of rotating said rotary drill head to cause said one or more engagement members to operatively engage said one or more recesses and thereby transmit torque directly from said first housing member to said second housing member.

The method can further include an act of rotating said rotary drill head to cause said one or more engagement members to operatively engage said one or more recesses and thereby reduce stresses transmitted to a plurality of fasteners securing said first housing member, said shock absorbing assembly, and said second housing member together.

Accordingly, implementations of the present invention can provide a number of different advantages over conventional shock absorbers. For example, implementations of the present invention include drill-string shock absorbers capable of absorbing both vibrations and shock impulses without leading to premature wear or failure. For instance, implementations of the present invention include shock absorbers configured to transmit rotational vibrations and torsional forces directly between ends of a generally cylindrical housing and reduce stresses applied to a shock absorbing system located within the cylindrical housing.

One will appreciate that implementations of the present invention can also be applied broadly with several different types of alterations within the scope of the present invention for yet additional advantages. For example, the shock absorbers 200 of the present invention need not be secured between a drilling head and a component of a drill string. In additional implementations of the present invention the shock absorbers 200 can be secured between adjacent members or components of a drill string.

The present invention may thus be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. An apparatus for reducing vibration and shock created in a drill string during a drilling operation, comprising:

a generally cylindrical housing including a first end and a second end coupled together by a radially interlocking joint formed by abutting surfaces of said first end and said second end; and a shock absorbing assembly disposed within said generally cylindrical housing adapted to absorb and dissipate shock impulses.

2. The apparatus of claim 1, wherein said abutting surfaces form at least a portion of an outer radial wall surrounding and enclosing said shock absorbing assembly.

3. The apparatus of claim 1, further comprising at least one protrusion extending longitudinally from said first end of said generally cylindrical housing into at least one recess extending longitudinally into said second end of said generally cylindrical housing.

4. The apparatus of claim 3, further comprising at least one protrusion extending longitudinally from said second end of said generally cylindrical housing into at least one recess extending longitudinally into said first end of said generally cylindrical housing.

5. The apparatus of claim 1, wherein said shock absorbing assembly comprises a piston disposed between two resilient discs.

6. The apparatus of claim 5, wherein said piston comprising a radially extending flange positioned between said resilient discs, said flange being adapted to transmit force to said resilient discs.

7. A drill-string shock absorber, comprising:

a first housing member adapted to be coupled to a rotary drive;

a second housing member adapted to be coupled to a drill string;

a shock absorbing assembly longitudinally disposed between said first housing member and said second housing member;

a plurality of fasteners extending from said second housing member through said shock absorbing assembly and into said first housing member; and a plurality of radially interlocking members formed by abutting surfaces of said first housing member and said second housing member, said radially interlocking members adapted to transmit torque directly from said first housing member to said second housing member and reduce stress experienced by said plurality of fasteners.

8. The drill-string shock absorber of claim 7, wherein said first housing member comprises a driving flange adapted to be coupled to the rotary drive and said second housing member comprises an output flange.

9. The drill-string shock absorber of claim 8, wherein said plurality of radially interlocking members formed by said abutting surfaces comprise an outer radial wall extending between said driving flange and said output flange.

10. The drill-string shock absorber of claim 8, further comprising a plurality of fastener sleeves extending between said driving flange and said output flange and through a plurality of holes formed in said shock absorbing assembly, wherein said plurality of fasteners are housed within said plurality of fastener sleeves.

11. The drill-string shock absorber of claim 7, wherein said plurality of radially interlocking members comprise a plurality of protrusions extending longitudinally from said second housing member into a plurality of recesses formed longitudinally into said first housing member.

12. A drill-string shock absorber, comprising:

a first flange comprising at least one engagement member extending longitudinally from an outer radial wall of said first flange;

a second flange comprising at least one recess extending longitudinally into an outer radial wall of said second flange, said at least one recess of said second flange being adapted to operatively engage said at least one engagement member of said first flange and to transmit torque directly from said first flange to said second flange;

a piston including a flange disposed between said first flange and said second flange;

at least a first shock absorbing member disposed between said first flange and said piston flange; and at least a second shock absorbing member disposed between said piston flange and said second flange.

13. The drill-string shock absorber of claim 12, further comprising a plurality of fasteners adapted to secure said first flange to said second flange.

14. The drill-string shock absorber of claim 13, wherein said at least one engagement member is adapted to operatively engage said at least one recess to reduce stress applied to said first flange from being transferred to said plurality of fasteners and transfer at least a portion of the torque applied to said first flange directly to said second flange.

15. The drill-string shock absorber of claim 13, wherein said plurality of fasteners extend through a plurality of holes formed in the piston flange, second shock absorbing member, and first shock absorbing member.

16. A drilling system comprising:

a tool string comprising a plurality of tubular members;

an earth-boring tool secured to a first end of said tool string;

a rotary drill head coupled to a second end of said tool string, said rotary drill head configured to rotate said tool string; and a shock absorber secured between said rotary drill head and said tool string, said shock absorber comprising:

a cylindrical housing including a first end and a second end coupled together by a radially interlocking joint formed by abutting surfaces of said first end and said second end; and a shock absorbing assembly disposed within said cylindrical housing adapted to absorb and dissipate shock impulses.

17. The drilling system of claim 16, wherein said tools string comprises a down-the-hole hammer.

18. The drilling system of claim 16, wherein said rotary drill head comprises a double-head rotary drill system.

19. A method of absorbing vibration and shock impulses during a drilling operation, comprising:

coupling a portion of a tool string to a shock absorber secured to a rotary drill head, said shock absorber comprising:

a first housing member including an outer radial wall, said outer radial wall including one or more engagement members extending longitudinally therefrom;

a second housing member including an outer radial wall, said outer radial wall including one or more recesses extending longitudinally therein; and a shock absorbing assembly disposed between said first housing member and said second housing member;

rotating said rotary drill head to cause said one or more engagement members to operatively engage said one or more recesses and thereby transmit torque directly from said first housing member to said second housing member.

20. The method of claim 19, further comprising rotating said rotary drill head to cause said one or more engagement members to operatively engage said one or more recesses and thereby reduce stress transmitted to a plurality of fasteners securing said first housing member, said shock absorbing assembly, and said second housing member together.

21. The method of claim 19, further comprising coupling a down-the-hole hammer to said second housing member.

* * * * *